US005868272A

United States Patent [19]

Deal

[11] Patent Number: 5,868,272

[45] Date of Patent: Feb. 9, 1999

[54] BEVERAGE CONTAINER

[76] Inventor: Richard E. Deal, 614 S. Moore, Algona, Iowa 50511

[21] Appl. No.: 662,985

[22] Filed: Jun. 13, 1996

Related U.S. Application Data

[63] Continuation-in-part of Ser. No. 251,528, May 31, 1994, abandoned, which is a continuation-in-part of Ser. No. 69,623, Jun. 1, 1993.

[51] Int. Cl.[6] ..... B65D 7/42

[52] U.S. Cl. ..... 220/669; 220/600; 220/DIG. 13; 220/914; 220/906

[58] Field of Search ..... 220/669, 600, 220/674, 602, DIG. 13, 914, 906

[56] References Cited

U.S. PATENT DOCUMENTS

| | | | |
|---|---|---|---|
| D. 95,035 | 4/1935 | Gayner . | |
| D. 102,451 | 12/1936 | Schaefer . | |
| 214,698 | 4/1879 | Perkins . | |
| D. 224,291 | 7/1972 | Mascia . | |
| D. 224,382 | 7/1972 | Mascia . | |
| D. 224,640 | 8/1972 | Mascia . | |
| D. 224,642 | 8/1972 | Mascia . | |
| D. 224,644 | 8/1972 | Mascia . | |
| D. 227,347 | 6/1973 | Bystedt . | |
| D. 227,872 | 7/1973 | Stanley . | |
| D. 230,956 | 3/1974 | Bystedt . | |
| D. 240,968 | 8/1976 | Hurst . | |
| D. 253,809 | 1/1980 | Hartung . | |
| D. 254,714 | 4/1980 | Mascia et al. . | |
| D. 285,534 | 9/1986 | Itoh et al. . | |
| D. 294,120 | 2/1988 | Griesing et al. . | |
| D. 295,375 | 4/1988 | Lang | D9/434 |
| D. 312,398 | 11/1990 | Neto | D9/382 |
| D. 313,177 | 12/1990 | Larson | D9/383 |
| D. 316,965 | 5/1991 | Arvidson et al. | D9/370 |
| D. 322,213 | 12/1991 | Maginnis, Jr. | D9/317 |
| D. 327,219 | 6/1992 | Hestehave et al. | D9/530 |
| D. 332,406 | 1/1993 | Desgrippes et al. | D9/571 |
| D. 337,273 | 7/1993 | Thatcher | D9/539 |
| D. 344,457 | 2/1994 | Prevot et al. | D9/537 |
| 1,559,624 | 11/1925 | Kopp . | |
| 2,905,350 | 9/1959 | Edwards | 215/1 |
| 3,372,830 | 3/1968 | Edwards | 220/9 |
| 3,420,367 | 1/1969 | Carmichael | 206/65 |
| 3,563,408 | 2/1971 | Bijvoet | 220/83 |
| 3,759,203 | 9/1973 | Frankenberg | 113/1 |
| 4,157,762 | 6/1979 | Robinson | 220/1 |
| 4,185,749 | 1/1980 | Vartia | 220/72 |
| 4,308,955 | 1/1982 | Schieser et al. | 206/509 |
| 4,860,908 | 8/1989 | Rumble et al. | 220/1 R |
| 4,925,050 | 5/1990 | Yu | 220/90 |
| 4,938,374 | 7/1990 | Wuchterl | 220/83 |
| 5,148,930 | 9/1992 | Ota et al. | 215/1 C |
| 5,165,557 | 11/1992 | Ota et al. | 215/1 C |

*Primary Examiner*—Joseph M. Moy
*Attorney, Agent, or Firm*—Zarley, McKee, Thomte, Voorhees & Sease

[57] ABSTRACT

An improved beverage container is provided, and has a top wall, a bottom wall, a side wall extending between and being integrally connected to the top and bottom walls. The side wall contains thumb and finger receiving portions which can be detented by applying pressure or by releasing pressure within the container. The thumb and finger receiving portions are oriented for gripping by a person's thumb and fingers. One of the finger receiving portions is positioned below an opening in the top wall of the container such that the container is automatically oriented for drinking or pouring when grasped by a person. The shape of the container can be that of a typical beverage can or plastic bottle. Circular rims adjacent the top and bottom walls of the container allow dispensing from conventional beverage machines.

9 Claims, 3 Drawing Sheets

BEVERAGE CONTAINER

CROSS-REFERENCE TO A RELATED APPLICATION

This application is a continuation-in-part of application Ser. No. 08/251,528 filed May 31, 1994, which is a continuation-in-part of application Ser. No. 08/069,623, filed Jun. 1, 1993.

BACKGROUND OF THE INVENTION

Beverage containers of numerous sizes and shapes have been known for many years for drinks such as pop, beer, juice and water. Perhaps the most common beverage container currently used by manufacturers is the 12 ounce cylindrical beverage can having a pop top opening.

In drinking from the conventional beverage container, one problem is that the can or bottle, generally containing a chilled liquid, has a tendency to acquire condensation on the cylindrical side wall of the container which may make the container slippery and difficult to handle.

Another problem with the conventional beverage container is the grasping of the container by children or adults with small hands can be difficult. Also, people with physical impairment of the hands, such as arthritis, often times have difficulty gripping a smooth cylindrical bottle or can.

Further, in drinking from the conventional 12 ounce cylindrical beverage can having a pop top opening, a problem is that the can must be rotated so that the opening is approximately aligned with the drinker's thumb, so that the opening can be easily positioned over the drinker's mouth for consumption of the beverage directly from the can, or aligned with a glass or cup such that the beverage can be poured into the glass or cup. Due to the cylindrical shape and uniform cross section of the can, such alignment of the opening with the drinker's mouth, or the cup or glass, cannot be accomplished by touch alone. That is, the user cannot merely grasp the cylindrical side of the can and have the opening aligned in the desired position. Rather, the user must visually perceive the opening and align it accordingly.

Accordingly, a primary objective of the present invention is the provision of an improved beverage container.

Another objective of the present invention is the provision of a beverage container capable of forming at least one indented or deformed side portion for easy grasping and for aligning the opening of a can in a desired orientation.

Still a further objective of the present invention is the provision of an improved beverage container which can be dispensed from the conventional coin-operated beverage machine.

Another objective of the present invention is the provision of a beverage container having at least one finger receiving portion, thereby increasing the user's ability to grasp the container.

These and other objectives will be apparent from the following description of the invention.

SUMMARY OF THE INVENTION

The beverage container of the present invention includes a top wall, a bottom wall, and a side wall extending between the top and bottom walls. The side wall includes a thumb receiving portion which is adapted for movement between a first position, generally flush and contiguous with the side wall, and a second position wherein the finger receiving portion is depressed and adapted to receive a user's thumb.

The container can be constructed so that the thumb receiving portion can be activated either by the initial opening of the container thereby releasing pressure and allowing the thumb receiving portion to depress or the thumb receiving portion can be manufactured such that a user, if desired, can depress the receiving portion from its first position contiguous with the curved wall of the container to its second position adapted to receive the user's thumb.

The container includes a circular rim adjacent the top and bottom of the side wall, thereby permitting the can or bottle to roll along a surface or track, such that it can be dispensed from conventional beverage machines. The top wall of the container can include a conventional pop top for opening the can or a threaded bottle cap. When the container is a typical beverage can, the thumb receiving portion is centrally aligned with the opening in the top wall of the can, such that, upon gripping the can, the opening in the top wall is oriented for drinking or pouring. An additional finger receiving portion may be provided on the side wall of the can or bottle opposite the thumb receiving portion.

DESCRIPTION OF THE PREFERRED EMBODIMENT

Figure 1:
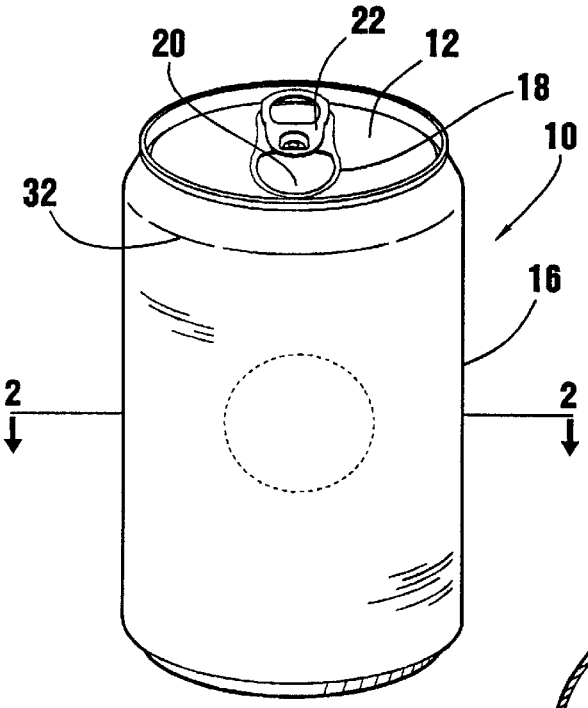
FIG. 1 is a perspective view of the improved beverage container of the present invention.

The improved beverage container of the present invention is generally designated in the drawings by the reference numeral 10. The container includes a top wall 12, a bottom wall 14, and a side wall 16. The walls 12, 14, and 16 have an integral construction so as to provide a sealed container for beverage within the container 10, such as pop, beer, juice or water.

In the drawing, the top wall 12 is shown to have an opening 18 which is normally sealed by a flap 20. The flap 20 can be depressed downwardly into the can by a tab 22 hinged to the top wall 12 of the container 10. The flap 20 and the tab 22 form a conventional pop top opening for a can, and does not constitute a part of the present invention. Other types of openings may also be provided, such as a pull top ring.

Figure 2:
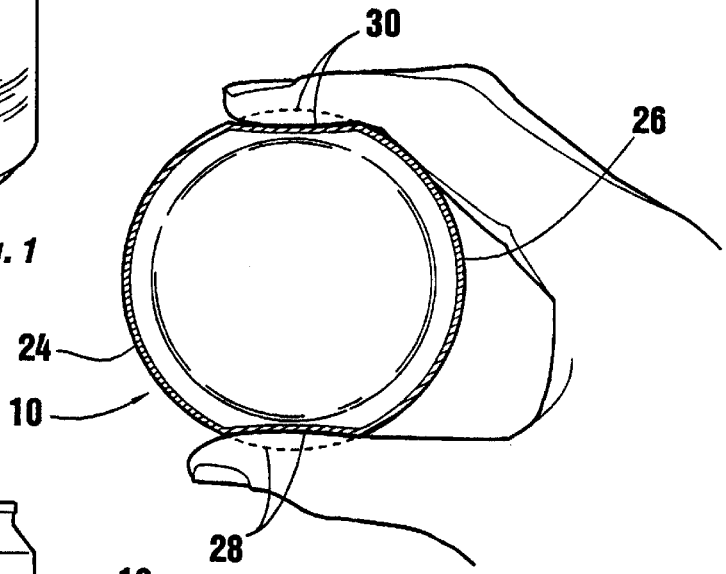
FIG. 2 is a sectional view taken along line 2—2 of FIG. 1.
Figure 3:
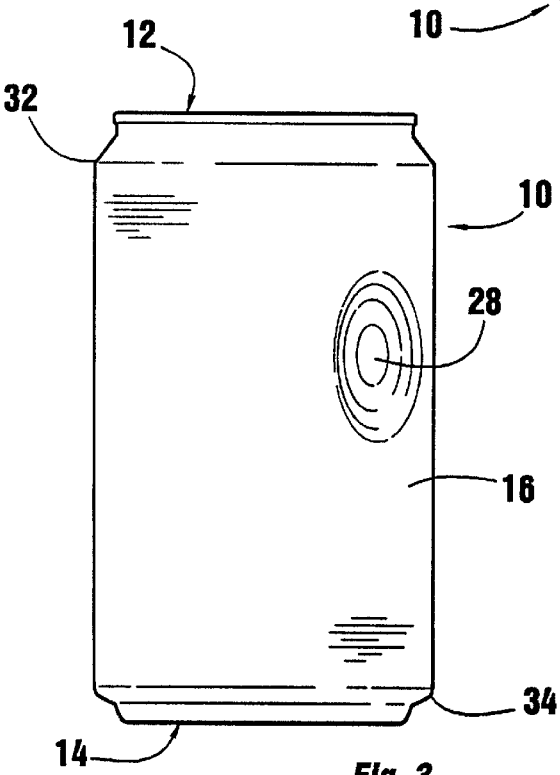
FIG. 3 is a side elevational view of the container.
Figure 4:
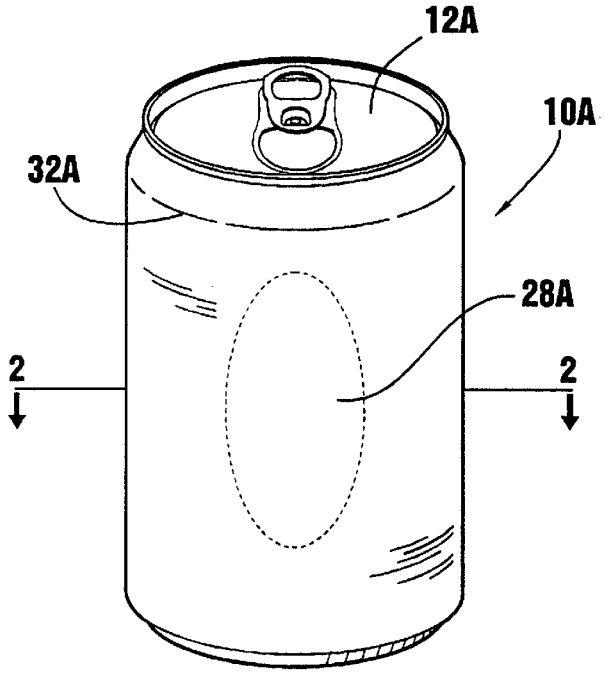
FIG. 4 is a perspective view of an alternative embodiment of the present invention.
Figure 5:
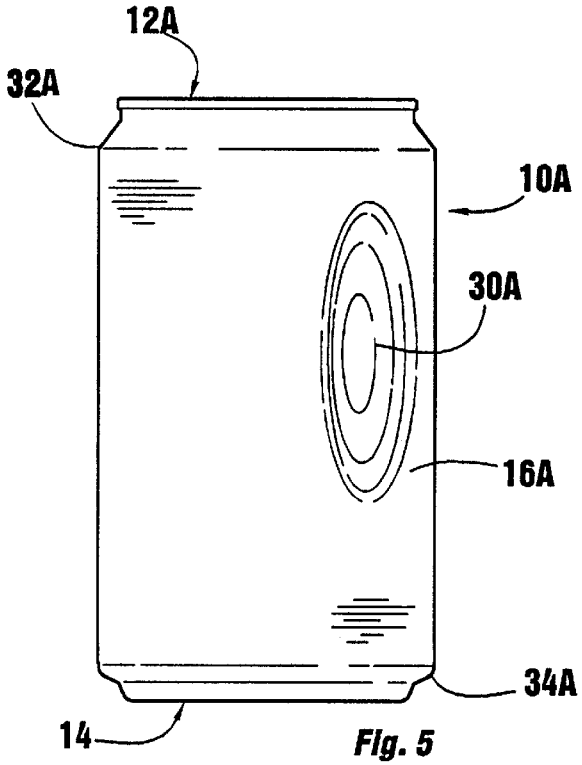
FIG. 5 is a side elevational view of the container of FIG. 4.

The side wall 16 includes opposite curved portions 24 and 26, and opposite thumb and finger receiving portions 28 and 30. The thumb and finger portions 28, 30 are shown in FIGS. 1–3 as being substantially circular in orientation. FIGS. 4 and 5 show an alternative embodiment of thumb and finger portions 28A, 30A shaped in a generally elliptical fashion. The thumb and finger receiving portions 28 and 30, while shown in circular and elliptical arrangements, can be comprised of any shape provided that portions 28, 30 are entirely provided between the upper rim 32 of container 10 and the lower rim 34 of container 10. This will allow for the presence of the thumb and finger portions 28, 30 on side wall 16 of container 10, while not interfering with the ability of the container to roll upon rims 32, 34 down a track or ramp such as in a standard soda dispensing machine. Thus, the improved beverage container 10 of the present invention can be dispensed from conventional beverage machines.

Portions 28, 30 are preferably contiguous with side wall 16 prior to the initial opening of container 10. Thumb and finger receiving portions 28, 30 are adapted for movement between a first position and a second position. The first position, as shown by the dotted line in FIG. 2, is contiguous with side wall 16 and positioned so as not to interfere with the rolling ability of container 10. The first position is maintained initially due to the pressure within the sealed container 10 provided by the beverage housed therein. After the initial opening, the thumb and finger receiving portions 28, 30 can be depressed to the second dimpled or indented position shown in FIG. 2 and adapted to allow added gripping ability and other advantages of the present invention. The movement of the thumb and finger receiving portions 28, 30 between the first position and second position can be achieved by providing manual pressure on the portions 28, 30 after the initial opening of container 10, or can be automatically achieved by adapting portions 28, 30 to dimple or indent on the release of pressure within container 10.

Alternatively, the portions 28, 30 may be formed as an indentation or depression in the side wall of the container which is present both when the container is sealed under pressure and when the container is open.

In the embodiment shown in FIGS. 1–3, the top wall 12 and the bottom wall 14 of the present invention are identical to conventional 12 ounce beverage cans such that the cans can be stacked one upon the other for storage and/or display. Also cans having the structure of the present invention can be packed in six-packs using conventional plastic six-pack retainer rings. The improved container 10 is preferably manufactured with dimensions identical to conventional cylindrical 12 ounce cans. Thus, container 10 maintains a 12 ounce capacity and can be easily displayed, stored and stacked with conventional cylindrical cans.

As mentioned earlier, FIGS. 4 and 5 show an alternative embodiment of container 10 wherein the thumb and finger receiving portions 28A, 30A are more elongated and elliptical than the portions 28, 30 shown in FIGS. 1–3. The can 10A is otherwise identical to can 10 in FIGS. 1–3, including circumferential upper and lower rims 32A. A further embodiment would have a similar elliptical portion turned 90° from that shown in FIG. 4 so that the longitudinal axis of the portion is substantially horizontal.

Figure 6:
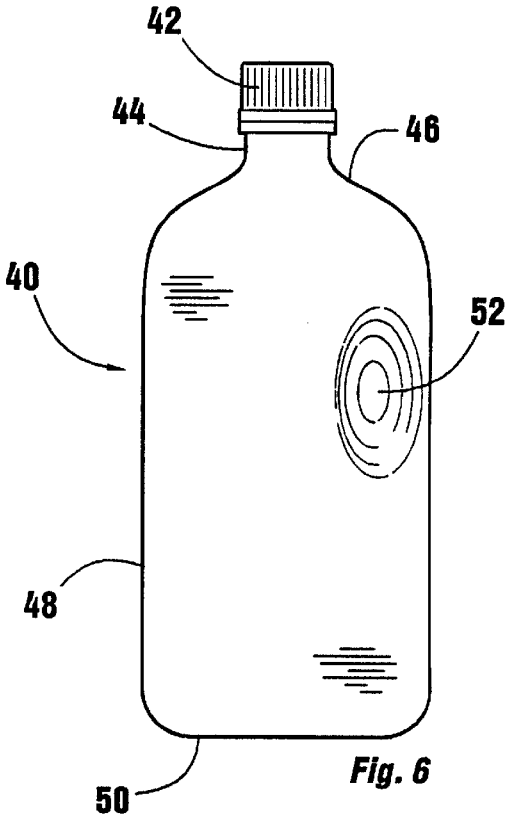
FIG. 6 is a side elevational view of another embodiment of the present invention.

FIG. 6 shows a different form for a container according to the present invention, that is, a plastic beverage bottle 40. The popularity of bottle 40 has increased recently due to its reliance on recyclable plastic. In general, the bottle 40 is comprised of a cap 42, a neck 44, an upper wall 46, a side wall 48, and a bottom wall 50. The cap 42 is adapted to be threadably placed on the neck 44 thereby containing any liquid therein. A thumb receiving portion 52 is positioned in the side wall 48 in a manner substantially similar to the previously described embodiment. The thumb receiving portion 52 can again be depressed due to manual pressure by a consumer or automatically through the release of pressure when the cap 42 is removed from the neck 44.

In use, a person grasps the container 10, 10A, 40 and can activate portions 28, 30, 28A, 30A, 52, by asserting pressure thereon, or simply by opening the container 10, 10A, 40 by activating the flap 20 or removing the cap 42. In the embodiment of FIGS. 1–5, the thumb receiving portion 28 should be aligned generally in a pouring path underneath opening 18. Proper positioning of the opening 18 thus can be accomplished by touch, with little, if any, visual perception of the container 10. Also, the thumb and finger receiving portions provide a specific gripping area for the user. Lastly, prior to depression, portions 28, 30 and side wall 16 provide a defined-area advertising panel on which beverage companies can promote the contents of the container 10, 40 or which can be used as advertising space for special local promotions.

It is understood that the position of the gripping portions may be raised or lowered, as compared to the position shown in the drawings. Additional gripping portions may also be provided around the container. Also, the thumb portion 28 may be circular, as seen in FIG. 1 and the finger portion 30 may be elliptical, as seen in FIG. 5. Other geometric shapes, such as a diamond, are also contemplated for the gripping portions.

Figure 7:
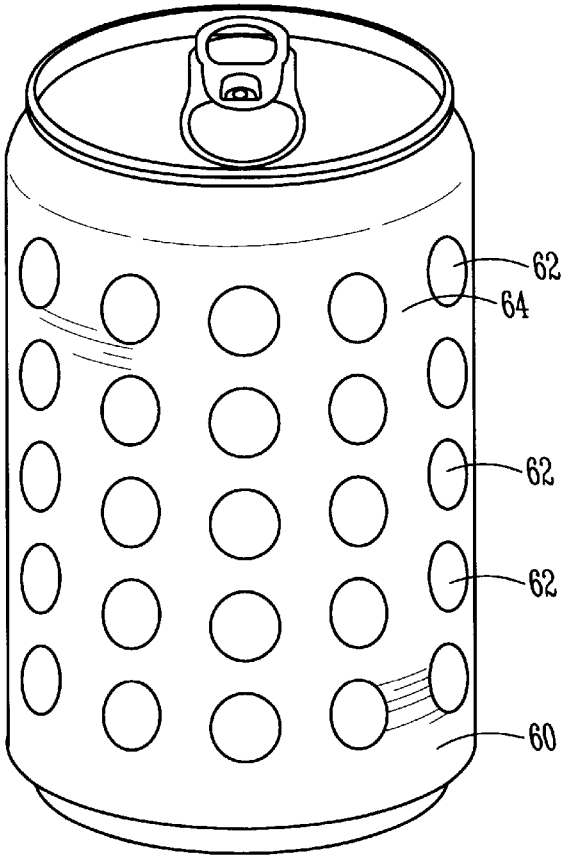
FIG. 7 is a perspective view of an alternative embodiment wherein a plurality of pre-stressed dimples are provided on the container.
Figure 8:
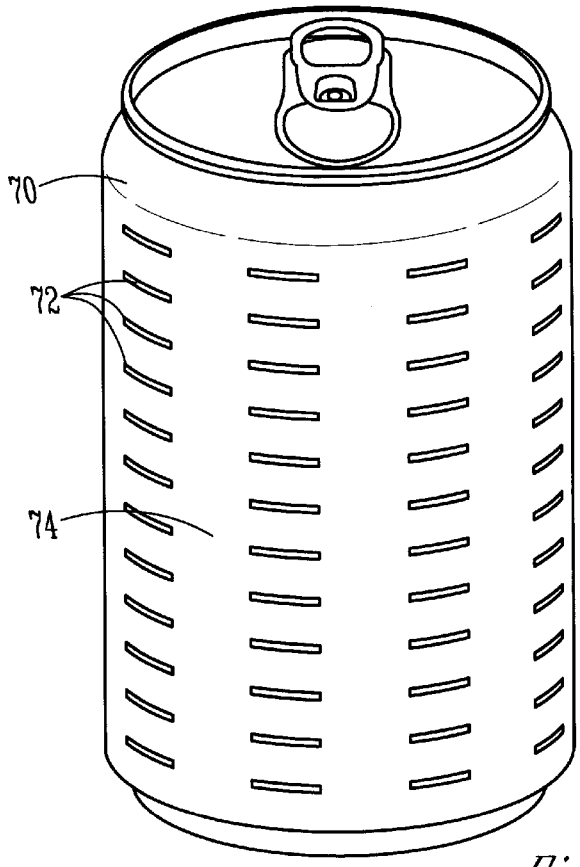
FIG. 8 is a perspective view of a further embodiment wherein a plurality of pre-stressed lines are provided on the container.

Alternative embodiments are shown in FIGS. 7 and 8 of the drawings. More particularly, the can 60 shown in FIG. 7 is substantially identical to the can 10 shown in FIG. 1, except that a plurality of pre-stressed areas or dimples 62 are provided on the side wall 64. The pre-stressed areas 62 are normally substantially flush with the side wall 64 of the can 60 when the can is sealed under pressure. When the can is opened and the pressure is released, the dimples move to an indented position relative to the side wall, thereby enhancing the grip of the can 60. The pre-stressed area 62 may be formed by passing the sealed can 60 through rollers or other convenient means.

Another embodiment is shown in FIG. 8 wherein the can 70 is provided with a plurality of pre-stressed areas 72 on the side wall 74. The pre-stressed areas 72 are in the form of lines or elongated, narrow rectangles. The pre-stressed areas 72 are substantially flush with the side wall 74 of the can 70 when the can is sealed, and automatically become depressed or indented when the can is opened and pressure is released. The pre-stressed area 72 may be formed by passing the sealed can through rollers or other convenient means.

In the embodiment shown in FIGS. 7 and 8, the pre-stressed areas 62, 72 may be formed in aligned columns and rows, or staggered columns and rows.

The invention has been shown and described above in connection with the preferred embodiment, and it is understood that many modifications, substitutions, and additions may be made which are within the intended broad scope of the invention. From the foregoing, it can be seen that the present invention accomplishes at least all of the stated objectives.

What is claimed is:

1. An improved beverage container comprising:

a beverage can having a cylindrical side wall; and a pre-stressed thumb receiving portion contained within the side wall and having a circular or elliptical shape, the thumb receiving portion being movable upon opening of the container from a first position flush with the side wall, to a second depressed position without deforming the rest of the side wall, said thumb receiving portion remaining set in the second position when moved thereto.

2. The container of claim 1 further comprising:

a top wall with means for selectively opening the can; and a bottom wall, wherein the side wall extends between and is integrally connected to the top and bottom walls.

3. The container of claim 2 wherein the top wall includes an opening for dispensing a liquid, the opening being aligned with the thumb receiving portion.

4. The container of claim 1 wherein the side wall has opposite upper and lower ends, the can further comprising a circular rim adjacent the upper and lower ends of the side wall.

5. The container of claim 1 wherein the thumb receiving portion moves from the first position to the second position as a result of pressure applied by a consumer.

6. The container of claim 1 wherein the thumb receiving portion moves from the first position to the second position automatically when the can is initially opened due to the release of pressure from the container.

7. The container of claim 1 further comprising a pre-defined finger receiving portion on the side wall opposite the thumb receiving portion, the finger receiving portion being movable upon opening of the can from a first position flush with the side wall to a second pre-defined depressed position without deforming the rest of the can, and remaining in the second position when moved thereto.

8. The improved beverage container of claim 1 wherein a plurality of pre-stressed areas are provided, each area being flush with the side wall when the container is sealed and being movable to an indented position when the pressure is released from the container.

9. An improved beverage container of claim 1 wherein the can has a top and a bottom, and the side wall is cylindrical substantially between the top and bottom of the can.

* * * * *